US008787794B2

(12) United States Patent
Miyazaki et al.

(10) Patent No.: US 8,787,794 B2
(45) Date of Patent: Jul. 22, 2014

(54) CARTRIDGE, IMAGE FORMING APPARATUS, AND DRUM ATTACHING METHOD

(75) Inventors: Jun Miyazaki, Numazu (JP); Noriyuki Komatsu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 13/093,332

(22) Filed: Apr. 25, 2011

(65) Prior Publication Data

US 2011/0268471 A1 Nov. 3, 2011

(30) Foreign Application Priority Data

Apr. 30, 2010 (JP) ..... 2010-105348
Apr. 15, 2011 (JP) ..... 2011-090966

(51) Int. Cl.
*G03G 15/00* (2006.01)

(52) U.S. Cl.
USPC ..... 399/117; 399/111

(58) Field of Classification Search
USPC ..... 399/117
See application file for complete search history.

(56) References Cited

U.S. PATENT DOCUMENTS 6,266,503 B1 7/2001 Murayama et al.
6,463,235 B1 * 10/2002 Yamanaka et al. ..... 399/117
6,671,477 B2 12/2003 Komatsu et al.
7,024,131 B2 4/2006 Komatsu et al.
7,110,703 B2 9/2006 Uratani et al.
7,156,797 B2 1/2007 Komatsu et al.
7,266,326 B2 9/2007 Karakama et al.
7,283,765 B2 10/2007 Uratani et al.
2004/0136746 A1 * 7/2004 Komatsu et al. ..... 399/104
2010/0278559 A1 11/2010 Komatsu et al.

FOREIGN PATENT DOCUMENTS

JP 2000-075733 3/2000

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

A cartridge detachably mountable to an image forming apparatus, the cartridge includes a photosensitive drum having a shaft provided adjacent one axial end; a frame; the frame being provided with a first bearing portion supporting a circumference of the shaft; the frame being provided with a second bearing portion supporting a circumference of the shaft, the second bearing portion being spaced from the first bearing portion with respect to the axial direction and being disposed in a side opposite from the first bearing portion with respect to a plane including an axis of the shaft at the time when the shaft is supported by the first bearing portion; a first clearance space, provided in a position opposite the first bearing portion with respect to the plane, wherein when causing the shaft to be supported by the first bearing portion, the shaft is capable of entering the first clearance space; and a second clearance space, provided in a position opposite the second bearing portion with respect to the plane, wherein when causing the shaft to be supported by the second bearing portion, the shaft is capable of entering the second clearance space.

14 Claims, 14 Drawing Sheets

(A)

(B)

CARTRIDGE, IMAGE FORMING APPARATUS, AND DRUM ATTACHING METHOD

FIELD OF THE INVENTION RELATED ART

The present invention relates to a cartridge, an image forming apparatus, and a drum attaching method. In particular, it is applicable to an image forming apparatus, such as a copy machine, a printer (for example, laser printer and LED printer), which form an image on recording medium (for example, ordinary paper and OHP sheet).

The cartridge mentioned in this specification is such a cartridge that is removably mountable in the main assembly of an image forming apparatus. It contains at least an electrophotographic photosensitive drum. It includes also a cartridge which is removably mountable in the main assembly of an image forming apparatus and integrally contains an electrophotographic photosensitive drum, and one or more means for processing the electrophotographic photosensitive drum. The cartridge is removably mountable in the main assembly of an image forming apparatus by a user him- or herself. Therefore, it can make it easier to maintain an image forming apparatus.

One of the conventional methods for attaching a photosensitive drum (image bearing member) to the frame of a cartridge is disclosed in Japanese Laid-open Patent Application 2000-75733. According to this application, the drum supporting shaft with which one of the lengthwise end of the photosensitive drum is provided is inserted through the hole of the cartridge frame, which is substantially greater in diameter than the drum supporting shaft, until the other lengthwise end of the photosensitive drum is positioned at a preset point in the cartridge frame, in terms of the lengthwise direction of the cartridge frame. Then, another drum supporting shaft is inserted into the hole with which the other end of the photosensitive drum is provided. Then, the bearing into which the drum supporting shaft of the first lengthwise end of the photosensitive drum is fitted is fitted into the aforementioned hole of the cartridge frame.

SUMMARY OF THE INVENTION

The present invention is an improvement of the aforementioned conventional art. Thus, the primary object of the present invention is to provide a cartridge, an image forming apparatus, and a photosensitive drum attaching method, which are simpler and more precise in terms of how a photosensitive drum is supported by the frame of a process cartridge.

According to an aspect of the present invention, there is provided a cartridge detachably mountable to an image forming apparatus, said cartridge comprising a photosensitive drum having a shaft provided adjacent one axial end; a frame; said frame being provided with a first bearing portion supporting a circumference of said shaft; said frame being provided with a second bearing portion supporting a circumference of said shaft, said second bearing portion being spaced from said first bearing portion with respect to the axial direction and being disposed in a side opposite from said first bearing portion with respect to a plane including an axis of said shaft at the time when said shaft is supported by said first bearing portion; a first clearance space, provided in a position opposite said first bearing portion with respect to the plane, wherein when causing said shaft to be supported by said first bearing portion, said shaft is capable of entering said first clearance space; and a second clearance space, provided in a position opposite said second bearing portion with respect to the plane, wherein when causing said shaft to be supported by said second bearing portion, said shaft is capable of entering said second clearance space.

According to another aspect of the present invention, there is provided an image forming apparatus for forming an image on a recording material, said image forming apparatus comprising a photosensitive drum having a shaft provided adjacent one axial end; a frame; said frame being provided with a first bearing portion supporting a circumference of said shaft; said frame being provided with a second bearing portion supporting a circumference of said shaft, said second bearing portion being spaced from said first bearing portion with respect to the axial direction and being disposed in a side opposite from said first bearing portion with respect to a plane including an axis of said shaft at the time when said shaft is supported by said first bearing portion; a first clearance space, provided in a position opposite said first bearing portion with respect to the plane, wherein when causing said shaft to be supported by said first bearing portion, said shaft is capable of entering said first clearance space; and a second clearance space, provided in a position opposite said second bearing portion with respect to the plane, wherein when causing said shaft to be supported by said second bearing portion, said shaft is capable of entering said second clearance space.

According to a further aspect of the present invention, there is provided a mounting method for manufacturing a cartridge detachably mountable to an image forming apparatus, the cartridge including a photosensitive drum having a shaft provided adjacent one axial end; a frame; the frame being provided with a first bearing portion supporting a circumference of the shaft; the frame being provided with a second bearing portion supporting a circumference of the shaft, the second bearing portion being spaced from the first bearing portion with respect to the axial direction and being disposed in a side opposite from the first bearing portion with respect to a plane including an axis of the shaft at the time when the shaft is supported by the first bearing portion; a first clearance space, provided in a position opposite the first bearing portion with respect to the plane, wherein when causing the shaft to be supported by the first bearing portion, the shaft is capable of entering the first clearance space; a second clearance space, provided in a position opposite the second bearing portion with respect to the plane, wherein when causing the shaft to be supported by the second bearing portion, the shaft is capable of entering the second clearance space, the method comprising a first step of moving the photosensitive drum such that a part of the shaft enters the first clearance space in a state that the photosensitive drum extends in a direction crossing with the axis; a second step, after the first step, of moving the photosensitive drum such that a part of the shaft enters the second clearance space in a state that the photosensitive drum extends in a direction crossing with the axis; and a third step of moving such that the shaft is brought into contact to the first bearing portion and the second bearing portion from a state that the photosensitive drum extends in a direction crossing with the axis.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 8(A) is a sectional view of the photosensitive drum bearing of the cartridge in the first preferred embodiment of the present invention, as seen from the direction of the axial line of the photosensitive drum; FIG. 8(B), a sectional view of the first portion of the bearing, as seen from the direction of the axial line of the photosensitive drum; FIG. 8(C), a sectional view of the second portion of the bearing, as seen from the direction of the axial line of the photosensitive drum; FIG. 8(D), a sectional view of the joint between the first and second portions of the bearing, as seen from the direction of the axial line of the photosensitive drum; and FIG. 8(E) is a sectional view of the joint between the first and second portions of the bearing, at a plane which coincides with the axial line of the photosensitive drum.

FIG. 9(A) is a sectional view of the photosensitive drum bearings of the cartridge in the second preferred embodiment of the present invention, as seen from the direction of the axial line of the photosensitive drum; FIG. 9(B), a sectional view of the first portion of the photosensitive drum bearing, as seen from the direction of the axial line of the photosensitive drum; FIG. 9(C), a sectional view of the second portion of the bearing, as seen from the direction of the axial line of the photosensitive drum; FIG. 9(D), a sectional view of the joint between the first and second portions of the bearing, as seen from the direction of the axial line of the photosensitive drum; and FIG. 9(E) is a sectional view of the joint between the first and second portion of the bearing, at a plane which coincides with the axial line of the photosensitive drum.

FIG. 10(A) is a sectional view of the photosensitive drum bearings of the cartridge in the third preferred embodiment of the present invention, as seen from the direction of the axial line of the photosensitive drum; FIG. 10(B), a sectional view of the first portion of the photosensitive drum bearing, as seen from the direction of the axial line of the photosensitive drum; FIG. 10(C), a sectional view of the second portion of the photosensitive drum baring, as seen from the direction of the axial line of the photosensitive drum; FIG. 10(D), a sectional view of the joint between the first and second portions of the bearing, as seen from the direction of the axial line of the photosensitive drum; and FIG. 10(E) is a sectional view of the joint between the first and second portions of the bearing, at a plane which coincides with the axial line of the photosensitive drum.

FIG. 11(A) is a sectional view of the photosensitive drum bearing of the cartridge in the fourth preferred embodiment of the present invention, as seen from the direction of the axial line of the photosensitive drum; FIG. 11(B), a sectional view of the first portion of the photosensitive drum bearing, as seen from the direction of the axial line of the photosensitive drum; FIG. 11(C), a sectional view of the second portion of the photosensitive drum baring, as seen from the direction of the axial line of the photosensitive drum; FIG. 11(D), a sectional view of the joint between the first and second portions of the bearing, as seen from the direction of the axial line of the photosensitive drum; and FIG. 11(E) is a sectional view of the joint between the first and second portions of the bearing, at a plane which coincides with the axial line of the photosensitive drum.

FIG. 12(A) is a sectional view of the bearing at a plane perpendicular to the plane which coincides with the axial line of the bearing; FIG. 12(B), a sectional view of the bearing as seen from the axial line of the bearing; and FIG. 12(C) is a perspective view of the bearing.

FIG. 13(A) is a sectional view of the bearing at a vertical plane which coincides with the axial line of the bearing; and FIG. 13(B) is a sectional view of the bearing as seen from the direction of the axial line of the bearing.

FIG. 14(A) shows the state of the photosensitive drum immediately before the mounting of the photosensitive drum; FIG. 14(B), the state of the photosensitive drum during the mounting of the photosensitive drum; and FIG. 14(C) shows the state of the photosensitive drum after the mounting of the drum.

DESCRIPTION OF THE PREFERRED EMBODIMENTS

Figure 1:
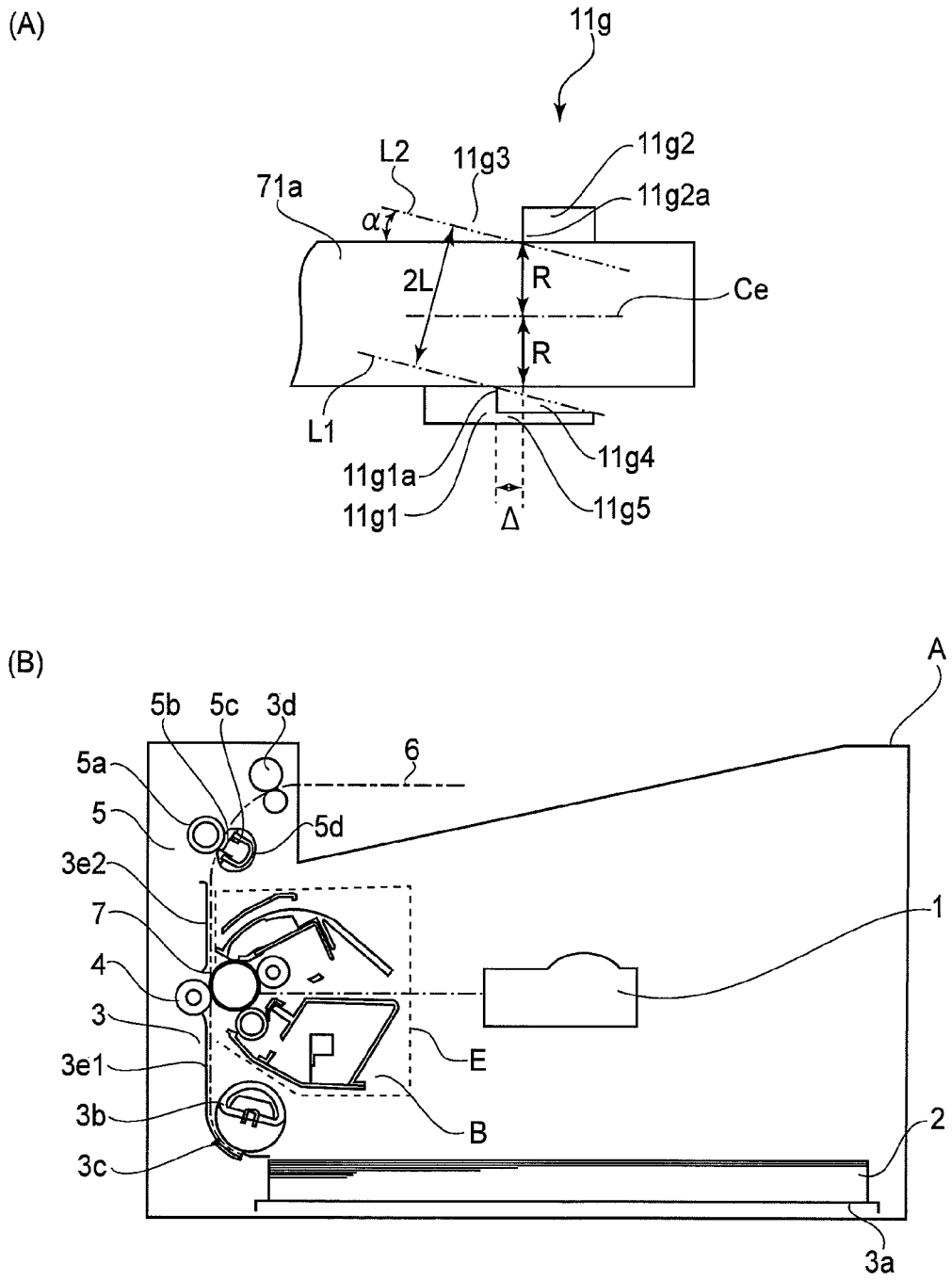
FIG. 1(A) is a schematic sectional view of the photosensitive drum supporting bearing in the first preferred embodiment of the present invention, and shows the basic structure of the bearing.
FIG. 1(B) is a schematic sectional view of the image forming apparatus in the first preferred embodiment of the present invention, and shows the general structure of the apparatus.

Hereinafter, the preferred embodiments of the present invention are described with reference to the appended drawings. In the following description of the preferred embodiments of the present invention, and the related drawings, the components which are the same or correspondent in function are given the same referential codes.

Embodiment 1

General Structure

FIG. 1(B) is a schematic sectional view of the electrophotographic image forming apparatus A (laser beam printer, for example), in the first preferred embodiment of the present invention, in which a process cartridge B is in the process cartridge chamber E of the main assembly of the apparatus A. It shows the general structure of the image forming apparatus. The process cartridge B is removably mountable in the main assembly of the image forming apparatus A which forms an image on recording medium.

The image forming operation of the apparatus A is as follows: The photosensitive drum 7 (image bearing member) is uniformly charged across its peripheral surface. Then, the exposing apparatus 1 scans the uniformly charged portion of the peripheral surface of the drum 7 with the beam of light which it projects while modulating the beam with the image formation signals generated in accordance with the information of the image to be formed. As a result, an electrostatic latent image is formed on the peripheral surface of the drum 7. This electrostatic latent image is developed into a visible image formed of developer (which hereafter will be referred to as toner). Meanwhile, one of the layered sheets 2 of recording medium (recording sheet, OHP sheet, fabric, etc.) in a cassette 3*a* is fed into the main assembly of the apparatus A, while being separated from the rest, by a combination of the a pickup roller 3*b* and a sheet pressing member 3*c* (which is kept pressed on pickup roller 3*b*). Then, the sheet 2 of recording medium is conveyed further into the main assembly while being guided by a sheet conveyance guide 3*e*1. While the sheet 2 of recording medium is being conveyed, the toner image on the drum 7 is transferred onto the sheet 2 of recording medium by the application of voltage to a transfer roller (transferring means). After the transfer, the sheet 2 of recording medium is conveyed to a fixing means 5 while being guided by the sheet guide 3*e*2. The fixing means 5 is made up of a driver roller 3*a* and a rotational fixing member 5*d*. The rotational fixing member 5*d* is a cylindrical sheet (endless sheet) and is supported by a supporting member 5*c* which holds a heater 5*b*. As the sheet 2 of recording medium is conveyed through the fixing means 5, the fixing means 5 fixes the transferred unfixed toner image on the sheet 2 to the sheet 2 by applying heat and pressure to the sheet 2 and the toner image thereon. After the sheet 2 is conveyed out of the fixing means 5, the sheet 2 is conveyed further and is discharged into a delivery tray 6 by a pair of discharge rollers 3*d* through a recording sheet conveyance path which delivers the sheet P in such a manner that the surface of the sheet 2, which was facing upward in the cassette 3*a*, faces downward in the delivery tray 6. In this embodiment, the pickup roller 3*b*, sheet pressing member 3*b*, discharge rollers 3*d*, etc., make up the recording medium conveying means.

(Process Cartridge)

Figure 2:
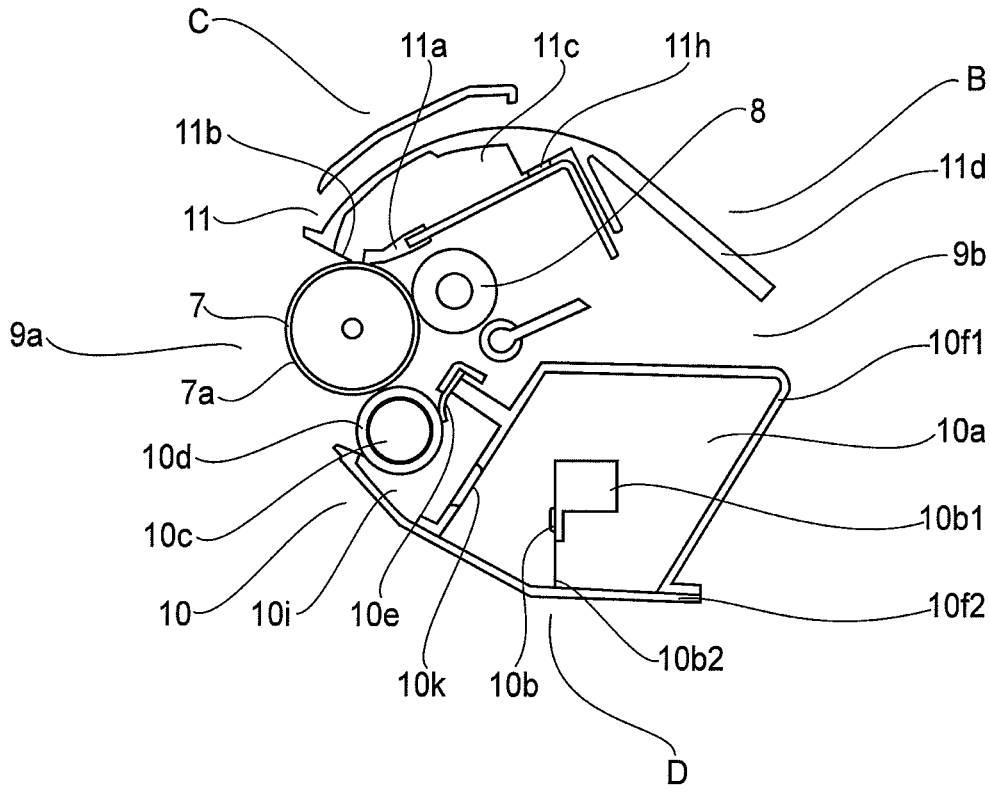
FIG. 2 is a schematic sectional view of the process cartridge in the first preferred embodiment of the present invention, and shows the general structure of the cartridge.

Referring to FIG. 2, the process cartridge B in this embodiment is made up of a cleaning device C by which the drum 7 is rotatably supported, and a developing device 10 which develops an electrostatic latent image on the peripheral surface of the drum 7, into a visible image.

The developing device D is in connection to the cleaning device C, and is rotationally movable relative to the cleaning device C. The cassette B is structured so that the developing device D and cleaning device C are kept pressed upon each other. As to the image formation by the cartridge B, while the drum 7 having a photosensitive layer is rotated, its peripheral surface is uniformly charged by the application of a preset voltage to the charge roller 8. Then, the uniformly charged portion of the peripheral surface of the drum 7 is exposed to the beam of light projected upon the peripheral surface of the drum 7 by the exposing apparatus 1 (FIG. 1(B)) through an exposure opening 9*b* while being modulated with the signals generated based on the information of the image to be formed. As a result, an electrostatic latent image is formed on the peripheral surface of the drum 7. This electrostatic latent image is developed by the developing means 10 (developing apparatus) into a visible image formed of toner (developer). After the formation of the toner image on the peripheral surface of the drum 7, the toner image is transferred onto the sheet 2 of recording medium by a transfer roller 4 (FIG. 1(B)) which faces the transfer opening 9*a*.

(Developing Apparatus)

Figure 3:
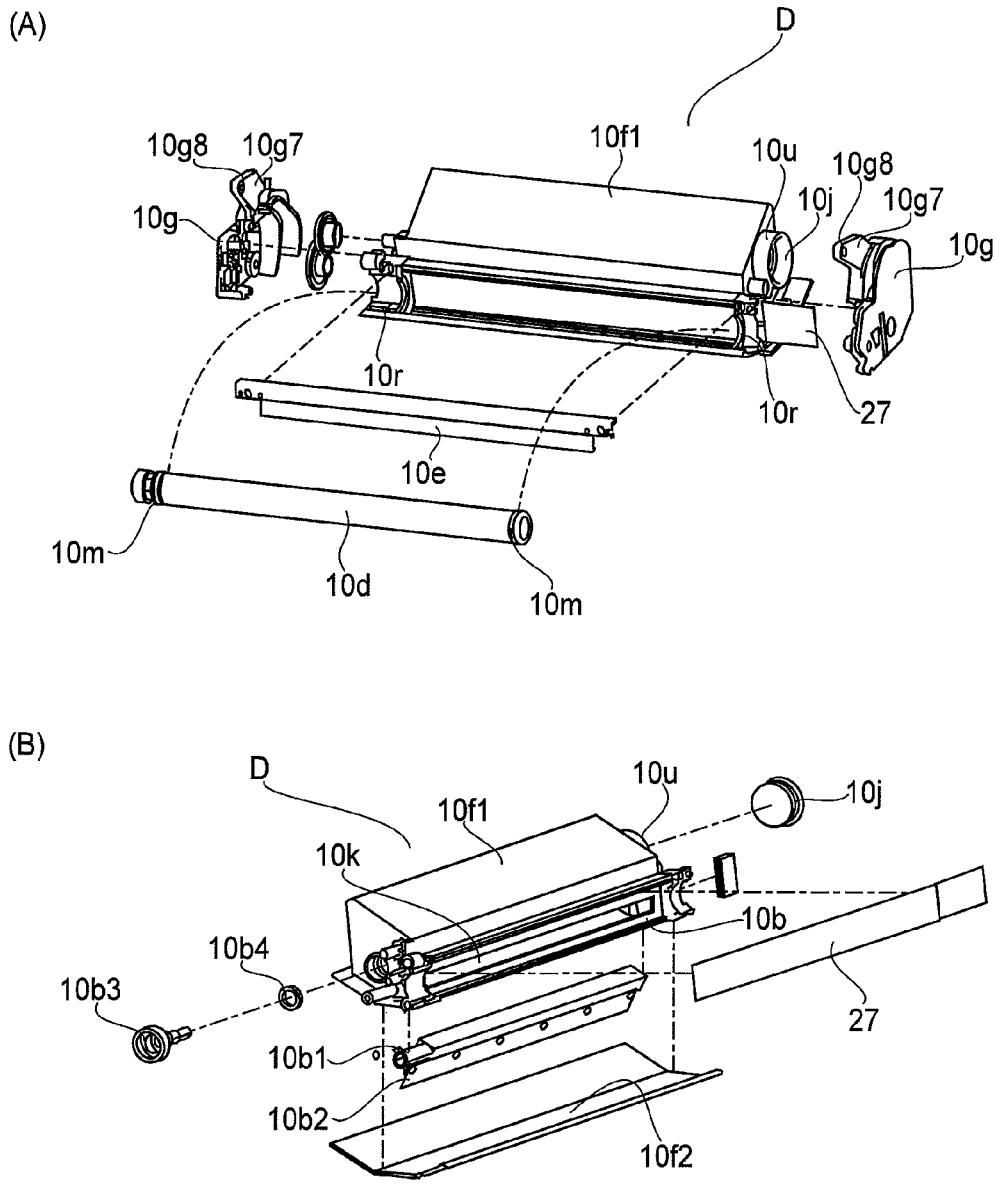
FIG. 3(A) is an exploded perspective view of the development chamber portion of the developing apparatus in the first preferred embodiment of the present invention.
FIG. 3(B) is an exploded perspective view of the toner storage chamber portion of the developing apparatus.

Next, referring to FIGS. 2 and 3, the developing apparatus D which is an integral part of the process cartridge B is described. Referring to FIG. 2, the frame of the developing apparatus D in this embodiment is made up of a first portion 10*f*1 and a second portion 10*f*2. It has: a chamber 10*a* which stores toner; and a chamber 10*i* in which an electrostatic latent image is developed with the use of the toner in the chamber 10*a*. The toner in the toner storage chamber 10*a* is sent to the development chamber 10*i* through a toner delivery opening 10*k* by a rotatable member 10*b*, which is a toner delivering means. The rotational member 10*b* has: a toner stirring shaft 10*b*1; and a sheet 10*b*2 solidly attached to the shaft 10*b*1. The developing apparatus D has also a development roller 10*d*, which is a developer bearing member. There is a stationary magnet 10*c* in the hollow of the development roller 10*d*. As the development roller 10*d* is rotated, a layer of frictionally charged toner is formed on the peripheral surface of the development roller 10*d* by a development blade 10*e* which is a member for regulating in thickness the toner layer formed on the peripheral surface of the development roller 10*d* as the development roller 10*d* is rotated. The toner particles in this toner layer are transferred onto the peripheral surface of the drum 7 in the pattern of the electrostatic latent image on the peripheral surface of the drum 7, developing thereby the latent image into a visible image, that is, an image formed of toner. This toner image is transferred onto the sheet 2 of recording medium by the application of voltage to the transfer roller 4 (FIG. 1(B)). The voltage applied to the transfer roller 4 is opposite in polarity to the toner.

Next, referring to FIG. 3(A), the developing apparatus D has: the development roller 10*d*; development blade 10*e*; and components for supplying the development roller 10*d* with electric power. These components are attached to the frame of the cartridge B during the assembly of the cartridge B. Each of the lengthwise end portions of the development roller 10*d* is provided with: a gap maintaining member 10*m* for keeping a preset amount of gap between the development roller 10*d* and drum 7; a seal 10*r* for preventing toner from leaking; and an end member 10*g*. The end member 10*g* has an arm 10*g*7 which has a hole 10*g*8 for rotatably attaching the developing apparatus D to the cleaning apparatus C. With the provision of this structural arrangement, the first portion 10*f*1 of the frame of the developing apparatus D is rotatably supported by the frame 11*d* of the cleaning apparatus C, in such a manner that the development roller 10*d* is kept parallel to the drum 7 with the presence of the aforementioned preset amount of gap between the development roller 10*d* and drum 7.

Next, referring to FIG. 3(B), one of the lengthwise ends of the first portion 10*f*1 of the frame of the developing apparatus D has an opening 10*u* for filling the toner chamber 10*a* with toner. The opening 10*u* is sealed with a cap 10*j* after the filling of the toner chamber with toner. The first portion 10*f*1 of the frame of the developing apparatus D, which is connected to the second portion 10*f*2 of the frame of the developing apparatus D, internally holds: the stirring shaft 10*b*1 for supplying the development roller 10*d* with toner; sheet 10*b*2 solidly attached to the stirring shaft 10*b*1, and also, for supplying development roller 10*d* with toner; a toner seal 27; etc. It has also an opening 10*k* as a toner passage. The toner seal 27 is for keeping sealed the opening 10*k* of the first portion 10*f*1 of the frame of the developing apparatus D, which is for allowing the toner in the toner chamber 10*a* to be supplied to the development roller 10*d*. It is thermally attached to the seal seat portion 10*h*, which correspond in position to the four edges of the opening 10*k*. The developing means 10 has also a seal 10*b*4 for preventing the toner leaking out of the first portion 10*f*1 of the frame of the developing apparatus D. The seal 10*b*4 is fitted around the stirring shaft 10*b*1 along with a gear 10*b*3 which is for transmitting driving force to the stirring shaft 10*b*1 and regulating the stirring shaft 10*b*1 in position in terms of the lengthwise direction of the stirring shaft 10*b*1.

(Cleaning Apparatus)

Figure 4:
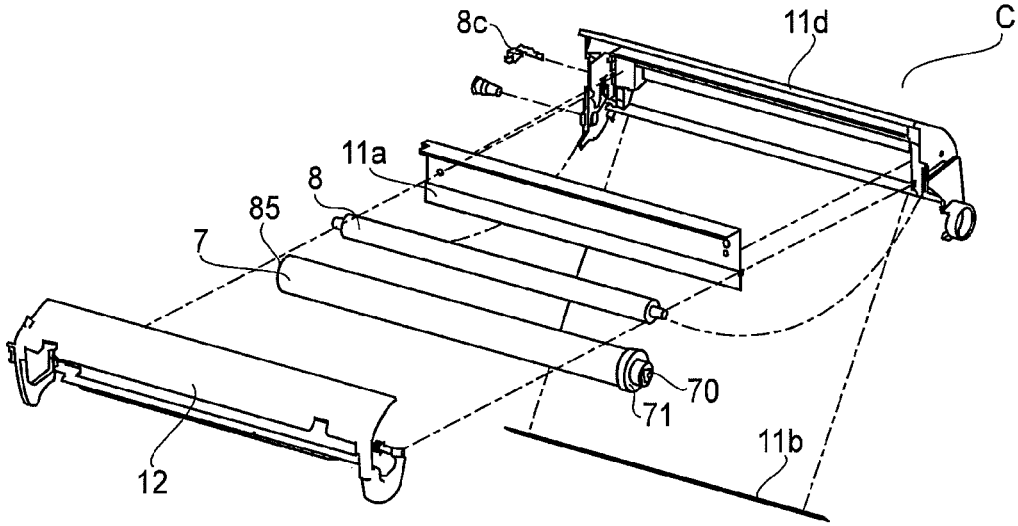
FIG. 4 is an exploded perspective view of the cleaning apparatus, and shows the general structure of the cleaning device.
Figure 4:
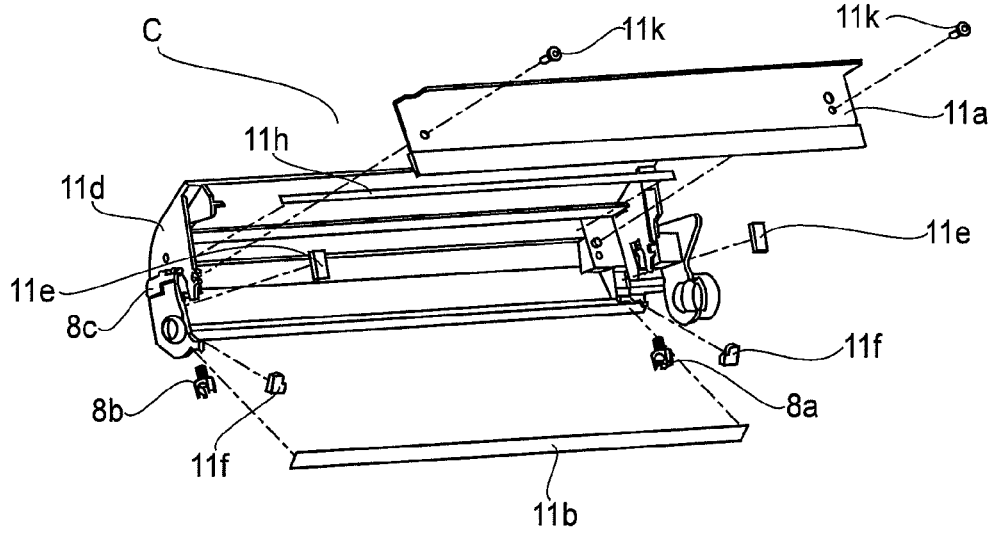

Next, referring to FIGS. 2 and 4, the cleaning apparatus C which holds the drum 7 is described. Referring to FIG. 2, the toner image formed through the development of the electrostatic latent image by the developing apparatus D is transferred onto the sheet 2 of recording medium through the transfer opening 9*a* of the transfer portion. The toner which is remaining on the drum 7 after the transfer is removed from the drum 7 by a cleaning means 11 attached to the frame 11*d* of the cleaning means 11, and is stored in the frame 11*d*. More specifically, the toner remaining on the peripheral surface of the drum 7 is scraped away from the peripheral surface of the drum 7 by the cleaning blade 11*a*, and as it is scraped away, it is scooped up and collected into the waste toner storage 11*c* sealed with the seal 11*h*, by a scooping sheet 11*b*. Instead of the cleaning blade 11*a*, a fur brush, a magnetic brush, or the like may be used as the cleaning means 11. Referring to FIG. 4(A), the drum 7, the cleaning apparatus C holds the charge roller 8, an electrode 8*c* for supplying the charge roller 8 with electric power, the cleaning blade 11*a*, the drum shutter 12, etc., which are attached to the frame 11*d* of the cleaning means 11. The cleaning apparatus C is structured so that when the process cartridge B is not in use, the transfer opening 9*c*, through which the drum 7 faces the transfer roller 4, remains covered with the drum shutter 12.

Figure 6:
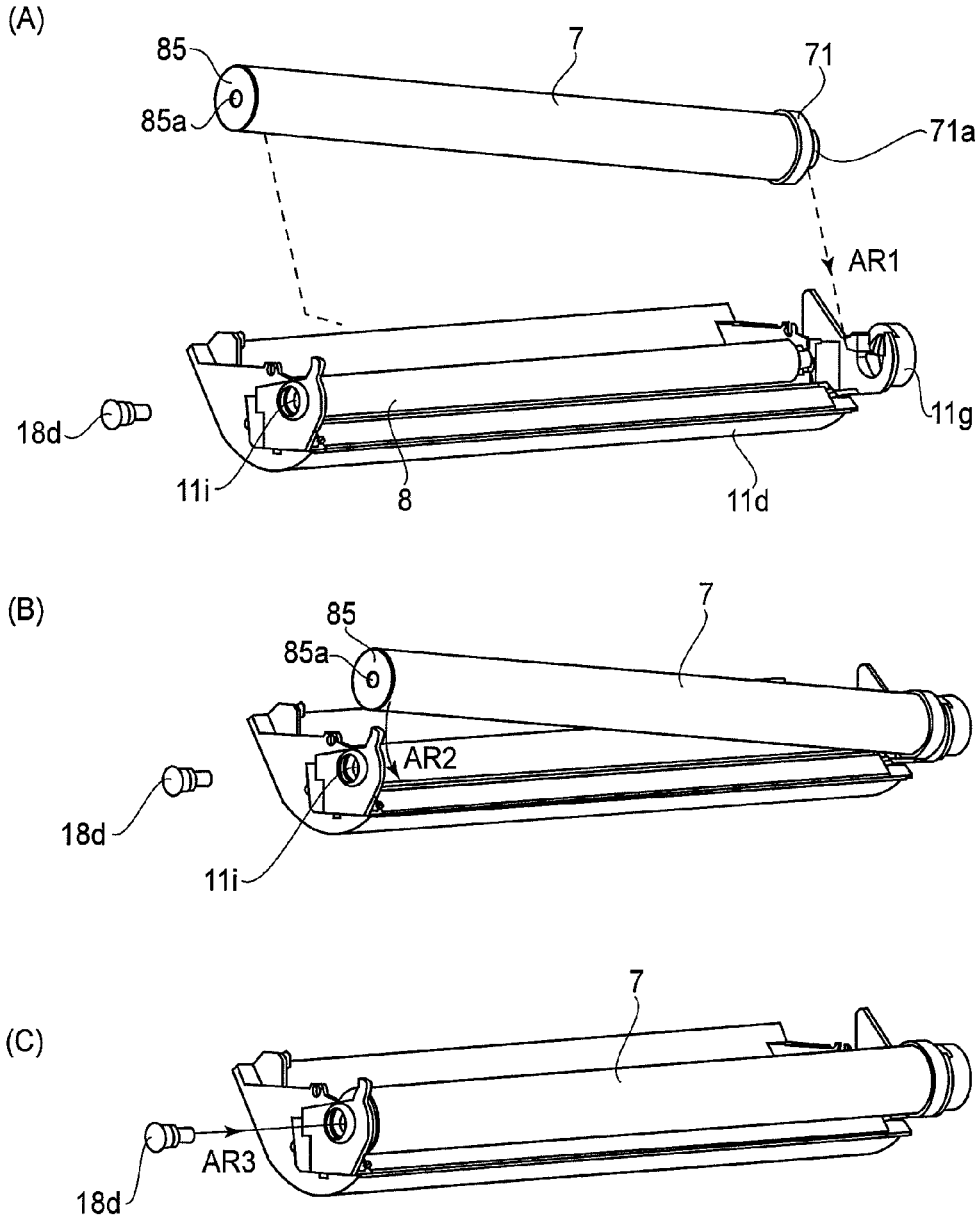
FIGS. 6(A), 6(B), and 6(C) are drawings for describing the procedure for mounting the photosensitive drum into the main assembly of the process cartridge, and show the state of the photosensitive drum and its adjacencies before, during, and after, respectively, the mounting of the drum.

One end of the drum 7 is fitted with a flange 71, whereas the other end of the drum 7 is fitted with a flange 8*g*. The flange 71 has: a coupler 71*b* for driving force transmission; a drum supporting shaft 71*a*; and a drum gear 71*c*. The flange 85 has a hole 85*a* (FIG. 6(A)), through which the other drum supporting shaft is put to support the drum 7. The drum gear 71*c* is for transmitting driving force to the development roller 10 and transfer roller 4. Next, referring to FIG. 4(B), the cleaning blade 11*a* is attached to a preselected portion of the frame 11*d* of the cleaning apparatus C with the use of small screws. Further, the process cartridge B has: a seal 11*e* for preventing the waste toner in the waste toner storage chamber 11*c* from leaking out of the chamber 11*c* from the lengthwise ends of the rear side of the cleaning blade 11*a*; and a seal 11*h* for preventing the toner leak which occurs on the rear side of the cleaning blade 11*a*. The two seals 11*e* and 11*h* are immovably attached to preselected portions, one for one, of the frame 11*d* of the cleaning apparatus C with the use of two-sided adhesive tape, or the like. The cartridge B has also: a seal 11*f* for preventing the toner from leaking out of the cassette B at the lengthwise ends of the rubber portion of the cleaning blade 11*a*; and the sheet 11*b* (toner scooping sheet) for scooping away the adherent substances, such as the residual toner, on the drum 7. The seal 11*f* and scooping sheet 11*b* are immovably attached to the frame 11*d* of the cleaning apparatus C with two-sided adhesive tape of the like.

The charge roller 8 has: an electrode 8*c* for supplying the charge roller 8 with the electric power from the main assembly A of the image forming apparatus; a bearing 8*b* which rotatably supports the charge roller 8; and a bearing 8*a*. The electrode 8*c* is attached to the frame 11*d* of the cleaning apparatus C by being fitted in the electrode slot of the frame 11*d*. The charge roller bearings 8*b* and 8*a* are assembled as integral parts of the frame 11*d*. The shaft portions of the charge roller 8 are fitted in the bearings 8*a* and 8*b* one for one. The bearings 8*a* and 8*b* are under the pressures from springs. Thus, the charge roller 8 is kept pressured toward the drum 7. Regarding the method for charging the drum 7, the method for charging the drum 7 may be one of the so-called contact charging methods, which uses a charge roller such as the charge roller 8 in this embodiment, or any of the conventional ones. For example, the drum 7 may be uniformly charged by using a charging means made up of a piece of tungsten wire, and a metallic shield which is made of aluminum or the like and surrounds the wire from three sides. In the case of this charging means, the peripheral surface of the drum 7 is uniformly charged by moving the positive or negative ions generated by applying high voltage to the wire, onto the peripheral surface of the drum 7. Further, the charging means may be in the form of a roller like the one in this embodiment, or a blade (charge blade), a pad, a block, a rod, etc., which have been used in the past.

(Mounting of Drum)

Figure 5:
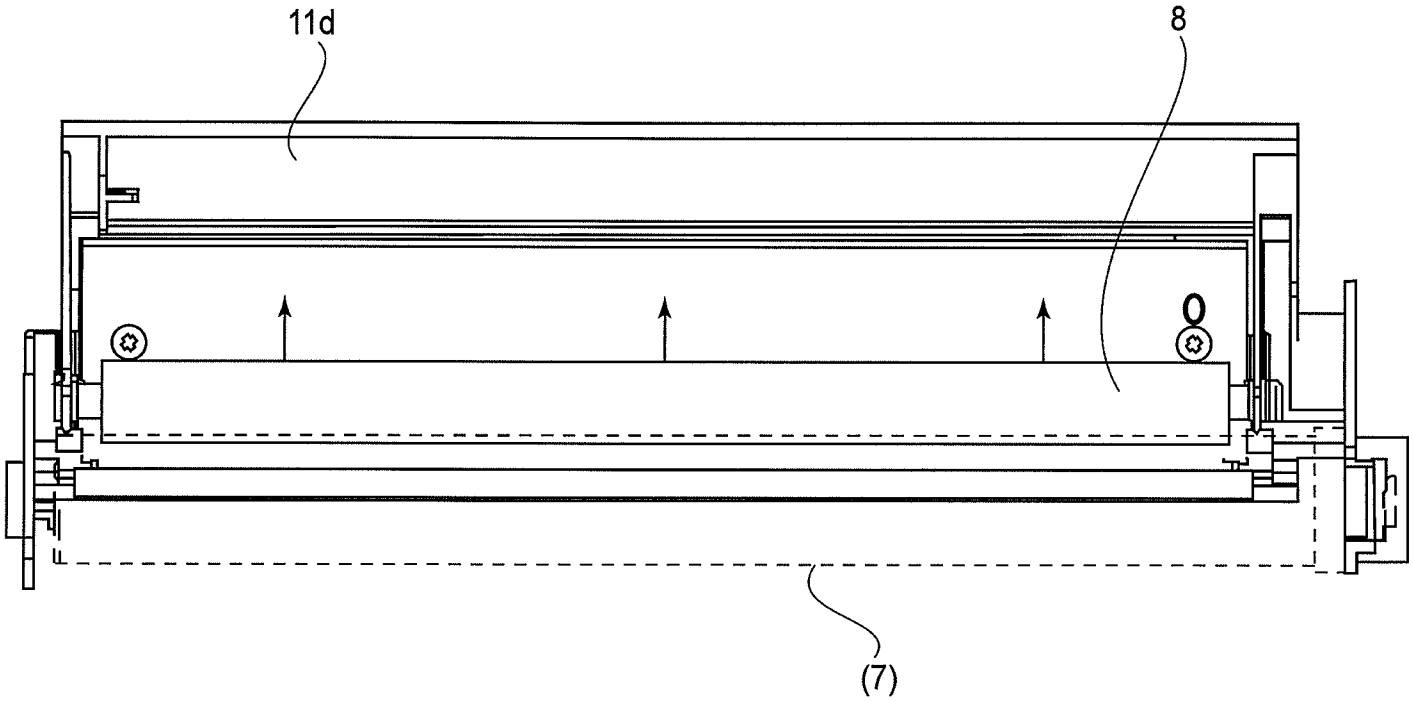
FIG. 5 is a drawing for describing how the charge roller is retracted when the photosensitive drum is mounted into the main assembly of the image forming apparatus.

Next, referring to FIGS. 5-7, and 14, the method for mounting the drum 7 (image bearing member which is in the form of a rotatably drum, and on which an image is formed) is described. The drum 7 is mounted into the frame 11*d* of the cleaning apparatus C in such a manner that the drum 7 is supported by the shaft 18*d* and bearing 11*d* of the frame 11*d* of the cleaning apparatus C (which hereafter will be referred to simply as cleaning apparatus frame 11*d*). Referring to FIG. 5, when the drum 7 is inserted into the cleaning apparatus frame 11*d*, the charge roller 8 is kept retracted in the direction indicted by arrow marks to prevent the charge roller 8 from interfering with the drum 7.

(General Procedure for Mounting Drum)

Referring to FIG. 6(A), one of the lengthwise ends of the cleaning apparatus frame 11*d* is provided with the bearing 11*g*, into which the drum supporting shaft 71*a* of the drum gear 71 is inserted. The other lengthwise end of the cleaning apparatus frame 11*d* is provided with a drum shaft insertion hole 11*i*, into which the drum shaft 18*d* is pressed. Next, the method for mounting the drum 7 into the cleaning apparatus frame 11*d* is described referring to FIG. 6(B). First, the drum supporting shaft 71*a* of the drum gear 7 is to be inserted into the bearing 11*g* from the direction indicated by an arrow mark AR1. Then, the hole 85*a* of the flange 85 is aligned with the drum shaft insertion hole 11*i* of the cleaning apparatus frame 11*d* by rotationally moving the drum 7 about the portion of the drum shaft 71*g*, which is in the bearing 11*g*, in such a direction that the flange (85) side of the drum 7 moves in the direction indicated by an arrow mark AR2. Then, the drum shaft 18*d* is to be moved in the direction indicated by an arrow mark AR3, as shown in FIG. 6(C), so that the drum shaft 18*d* is put through the drum shaft insertion hole 11*i* of the cleaning apparatus frame 11*d*, and then, through the hole 85*a* of the flange 85.

(Insertion of Drum Supporting Shaft into Bearing)

Referring to FIG. 7(A), the drum supporting shaft 71*a* is coaxial with the coupler 71*b* to which the drum driving force is transmitted from the main assembly A of the image forming apparatus. The drum supporting shaft 71*a* of the drum gear 71 is to be inserted into the bearing 11*g* in a direction which is angled relative to the axial line of the bearing 11*g*. Then, it is to be placed in contact with the first and second portions 11*g*1 and 11*g*2 of the bearing 11*g*, as shown in FIG. 7(C). The first and second portions 11g1 and 11g2 of the bearing 11g are shaped so that they match the drum supporting shaft 71a in shape and radius. Thus, the drum 7 is precisely positioned relative to the cartridge frame (and also, charge roller 8, development roller 10d, etc.).

Referring again to FIG. 7(A), in order to make it possible for the drum supporting shaft 71a to be inserted into the bearing 11g in the direction angled relative to the axial line of the bearing 11g, the first and second portions 11g1 and 11g2 of the bearing 11g are provided with first and second recesses (clearance recesses) 11g3 and 11g4, respectively. Further, the joint 11g5 between the first and second portions 11g1 and 11g2 of the bearing 11g is provided with the first and second recesses 11g3 and 11g4. This structural arrangement will be described later in detail. FIG. 7(A) shows an extension 11g6 (semicircular, and the same in thickness as the joint 11g5), which extends from the second portion 11g2 of the bearing 11g in the opposite direction from the lengthwise center of the drum 7. However, the extension 11g6 is just for increasing the bearing 11g in overall strength, and therefore, the provision of the extension 11g6 is not mandatory.

The following is a more concrete description of the method for attaching the drum 7 to the cleaning apparatus frame 11d. That is, first, referring to FIG. 7(A), the drum 7 is moved in such a manner that the axial line of the drum 7 is intersectional to the axial line Ce of the bearing 11g, and also, that the drum supporting shaft 71a partially enters the first recess 11g3 (First Step). Then, referring to FIGS. 7(B) and 14(A), the drum 7 is moved further in such a manner that the axial line of the drum 7 remains intersectional to the axial line Ce of the bearing 11g, and also, that the drum shaft 71a partially enters the second recess 11g4 (Second Step). Then, referring to FIGS. 7(C) and 14(B), the drum 7, which is kept in the state in which its axial line is angled relative to the axial line Ce of the bearing 11g, is moved in such a manner that the drum supporting shaft 71 is supported by the first and second portions 11g1 and 11g2 of the bearing 11g (Third Step). Thus, the axial line of the drum 7 becomes coincident with the axial line Ce of the bearing 11g. Next, referring to FIGS. 14(B) and 14(C), the drum shaft 18d is inserted through the drum shaft insertion hole 11i of the cleaning apparatus frame 11d, and then, is inserted into the drum shaft insertion hole 85a of the flange 85 (Fourth Step). Thus, the drum 7 becomes properly positioned relative to the cleaning apparatus frame 11d in terms of the direction perpendicular to the axial line of the drum 7. Further, in terms of the direction parallel to the axial line of the drum 7, the drum 7 is regulated in movement by the lateral portion 11d1, as the first regulating portion, of the cleaning apparatus frame 11d, and the lateral portion 11g7 of the bearing 11g, as the second regulating portion. That is, the drum 7 has: the end portion 85b, which is the first portion to be regulated, and can come into contact with the lateral portion 11d1; and the end portion 71c1, which is the second portion to be regulated and can contact the lateral portion 11g7. The end portion 71c1 is the surface of the drum gear 71c, from which the supporting shaft 71a projects. Further, referring to FIG. 14(C), the relationship among the dimensions d1, d2, and d3 of the drum 7 and cleaning apparatus frame 11d in terms of the direction parallel to the axial line of the drum 7 is as follow:

$$d1<d2<d3 \quad (1)$$

d1: distance between the lateral portions 11d1 and 11g7 of the cleaning apparatus frame 11d in terms of the direction parallel to the axial line of the drum 7 d2: distance between the two ends 71c1 and 85b of the drum 7 in terms of the direction parallel to the axial line of the drum 7 d3: distance between the tip of the coupler 71b and the lengthwise end 85b of the drum 7 in terms of the direction parallel to the axial line of the drum 7.

That is, because the bearing 11g is structured as described above, the distance between the lateral portions 11d1 and 11g7 of the cleaning apparatus frame 11d do not need to be made greater than the distance between the tip of the coupler 71b and the end portion 85b. Therefore, it is possible to reduce in size the process cartridge B in terms of the direction parallel to the axial line of the drum 7.

(Detailed Description of Bearing Shape)

Figure 8:
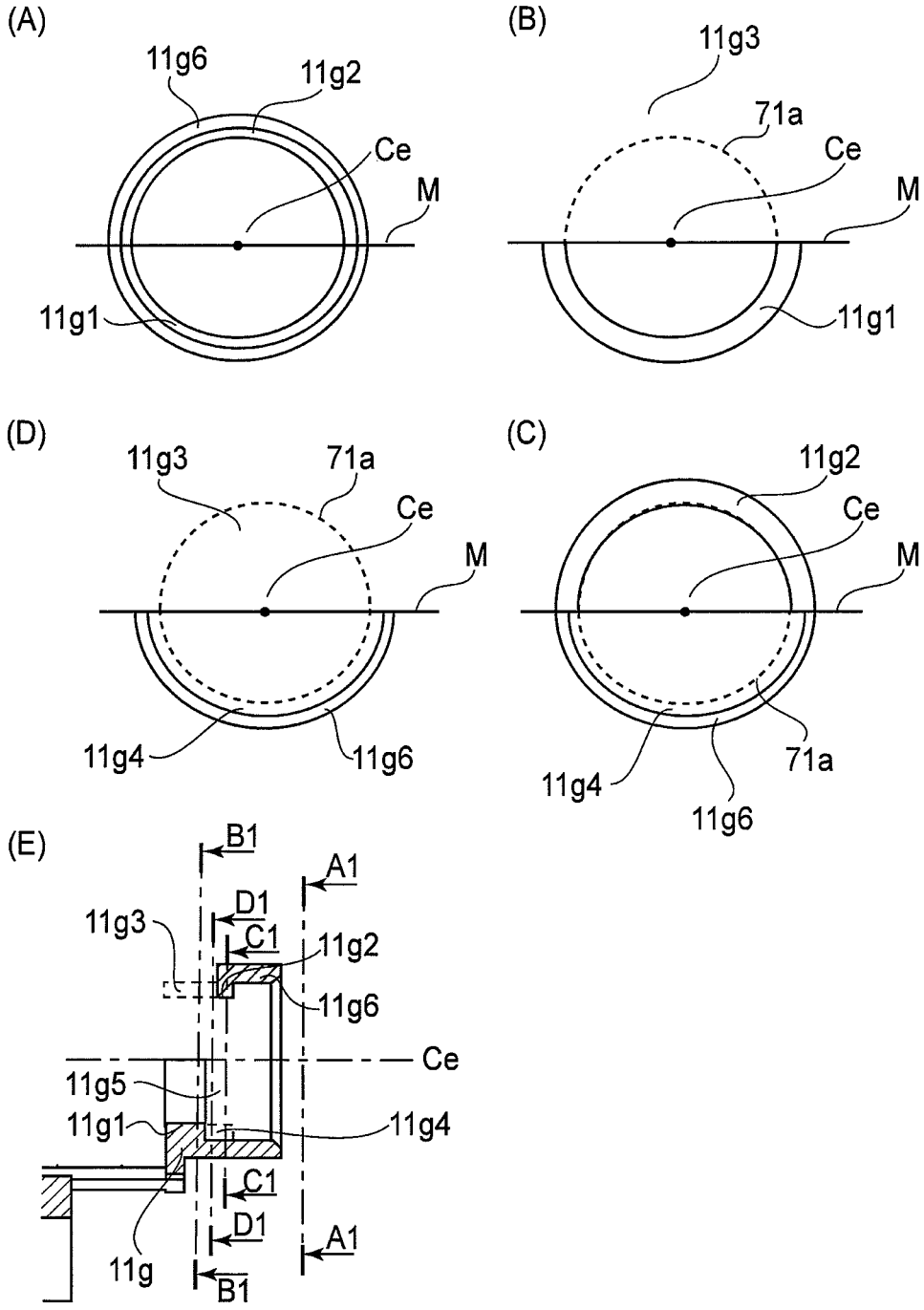
FIG. 8 relates to the photosensitive drum bearing in the first preferred embodiment of the present invention.

Referring to FIG. 1(A), the bearing 11g in this embodiment has: the first and second portions 11g1 and 11g2, which correspond in position to the drum supporting shaft 71a which is at one of the lengthwise ends of the drum 7. In terms of the direction parallel to the axial line Ce of the bearing 11g, the second portion 11g2 of the bearing 11g is further from the lengthwise center of the cartridge B than the first portion 11g1 of the bearing 11g. Referring to FIG. 8, the shape and radius of each of the first and second portions 11g1 and 11g2 of the bearing 11d are set so that the drum supporting shaft 71a is precisely supported by the bearing 11g. The second portion 11g2 of the bearing 11g is on the opposite side of a flat plane M (FIG. 8), which is coincident with the axial line Ce of the first portion 11g1 of the bearing 11g, from the first portion 11g1 of the bearing 11g. Further, the bearing 11g is structured (shaped) so that there is a gap Δ between the end surface 11g2a of the second portion 11g2 of the bearing 11g, which is closer to the first portion high of the bearing 11g than the end surface 11g2a of the second portion 11g2 of the bearing 11g, and the end surface 11g1a of the first portion 11g1 of the bearing g, in terms of the direction parallel to the axial line Ce of the bearing 11g (FIG. 1). Further, the bearing 11g is provided with the first and second recesses 11g3 and 11g4. The first recess 11g3 is on the opposite side of the flat plane M from the first portion 11g1 of the bearing 11g. The second recess 11g4 is on the opposite side of the flat plane M from the second portion 11g2 of the bearing 11g. Therefore, when attaching the drum 7 to the cleaning apparatus frame 11d by fitting the supporting shaft 71a into the bearing 11g, the supporting shaft 71a can be inserted into the bearing 11g at an angle. That is, the drum 7 can be inserted into the cleaning apparatus frame 11d at an angle α relative to the first and second portions 11g1 and 11g2 of the bearing 11g. More concretely, a straight line L1 which coincides with the edge 11g1b of the first portion 11g1 of the bearing 11g, the angle of which relative to the axial line Ce of the bearing 11g is α, and a straight line L2 which coincides with the edge 11g2b of the second portion 11g2 of the bearing 11g, the distance L between the two straight lines L1 and L2, and the radium R of the drum supporting shaft 71a, have to satisfy the following requirement: 2L>2R.

$$2L=(2R+\Delta \tan \alpha)\times\cos \alpha=2R \cos \alpha+\Delta \sin \alpha$$

Therefore, $$\Delta>2R(1-\cos \alpha)/\sin \alpha, \Delta>0$$

That is, if Δ=0, the drum 7 cannot be angularly inserted.

FIGS. 8(A)-8(D) are sectional views of the bearing 11g at planes A1-A1, B1-B1, C1-C1, and D1-D1, respectively, in FIG. 8(E), which are perpendicular to the axial line of the bearing 11g. Referring to FIG. 8(B), in order to allow the supporting shaft 71a to be inserted at an angle into the bearing

11g, the first portion 11g1 of the bearing 11g is on one side of the flat plane M which is coincident with the axial line Ce of the bearing 11g (axial line of supporting shaft 71a or rotational axis of drum 7), and the first recess 11g2 is on the opposite side of the flat plane M from the first portion 11g1. Next, referring to FIG. 8(C), the second recess 11g4 is on the opposite side of the plane M from the second portion 11g2 of the bearing 11g. In this embodiment, the first and second recesses 11g3 and 11g4 are different from each other in that the former was created by eliminating a portion of the bearing 11g, whereas the latter was created by partially removing the inward portion of the bearing 11g. However, they are the same in that both are recesses.

Next, referring to FIG. 8(D), like the first portion 11g1 of the bearing 11g, the joint 11g5 of the bearing 11g, which corresponds with the recess 11g3, is on the opposite side of the plane M from the recess 11g3. Next, referring to FIG. 8(C), on the opposite side of the plane M from the second portion 11g2 of the bearing g, there is the second recess 11g4, which is the inward side of the extension 11g6.

In this embodiment, the supporting shaft 71a is attached to the drum 7. The bearing 11g, and the cleaning means 11 for removing the developer remaining on the drum 7, are attached to the cleaning apparatus frame 11d. Further, the first portion 11g1 of the bearing 11g, which is on the inward side of the cleaning apparatus frame 11d in terms of the direction parallel to the axial line Ce, being therefore closer to the peripheral surface 7a of the drum 7, has the recess 11g3, which is away from the cleaning means 11 in terms of the radium direction of the drum 7.

In the case of a cartridge in accordance with the prior art, if an attempt is made to insert the supporting shaft into the bearing at an angle relative to the axial line of the bearing, the bearing interferes with the insertion of the supporting shaft. Therefore, the angle by which the supporting shaft is allowed to be tilted is limited to the amount tolerable by the clearance between the peripheral surface of the supporting shaft, and the inward surface of the bearing. In comparison, in the case of the cartridge in this embodiment, the bearing 11g is provided with the recess 11g3 and 11g4. Therefore, even if the supporting shaft 71a is inserted into the bearing 11g at an angle relative to the axial line of the bearing 11g, the bearing 11g does not interfere with the insertion of the supporting shaft 71a, as long as the angle is not excessive (FIG. 7(A).

Figure 7:
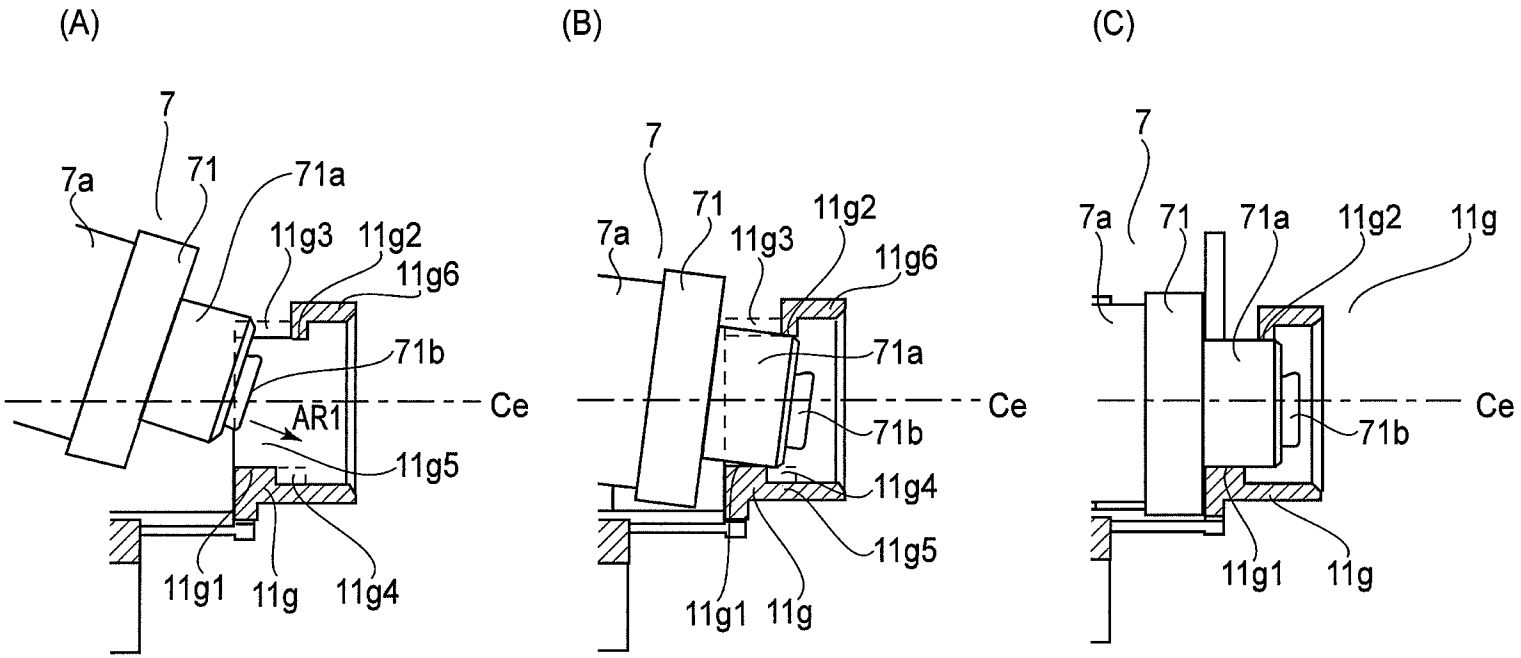
FIGS. 7(A), 7(B), and 7(C) are drawings for describing the procedure for fitting one of the lengthwise ends of the shaft of the photosensitive drum into the corresponding bearing of the frame of the cartridge, and show the state of the end of the drum shaft, and the corresponding bearing, before, during, and after, respectively, the fitting of the shaft into the bearing.

Next, the force to which the drum 7 is subjected is described. Referring to FIG. 2, the cartridge has the cleaning blade 11a, charge roller 8, development roller 10d, transfer roller 4, etc., which are drum processing means, in the adjacencies of the peripheral surface of the drum 7. Thus, the drum 7 is subjected to the forces from these processing means. Further, during an image forming operation, the drum 7 is subjected to the friction, which occurs as the cleaning blade 11a rubs the peripheral surface of the drum 7, the forces generated by the meshing of the drum gears 71 with the gear for driving the transfer roller 4 and the gear for driving the development roller 10d. Therefore, during an image forming operation, the drum supporting shaft 71a continuously remains under the combination of these forces while remaining in the bearing 11g. More concretely, referring to FIG. 2, the drum 7 remains pressured toward the cleaning blade 11a. This is why the first portion 11g1 of the bearing 11g, which bears the force which presses the drum 7 toward the cleaning blade 11a, is placed close to the peripheral surface 7a of the drum 7 in terms of the direction parallel to the axial line of the drum 7, as shown in FIG. 7. Further, in terms of the direction parallel to the axial line of the drum 7, the dimension of the first portion 11g1 of the bearing 11g is made greater than that of the second portion 11g2 of the bearing 11g. Further, when the supporting shaft 71a is inserted into the bearing 11g, the first portion high of the bearing 11g is more likely to be impacted by the drum supporting shaft 71a than the second portion 11g2 of the bearing 11g. Therefore, it is desired that the first portion high of the bearing 11g is made longer, being therefore stronger, than the second portion 11g2 of the bearing 11g.

Embodiment 2

Figure 9:
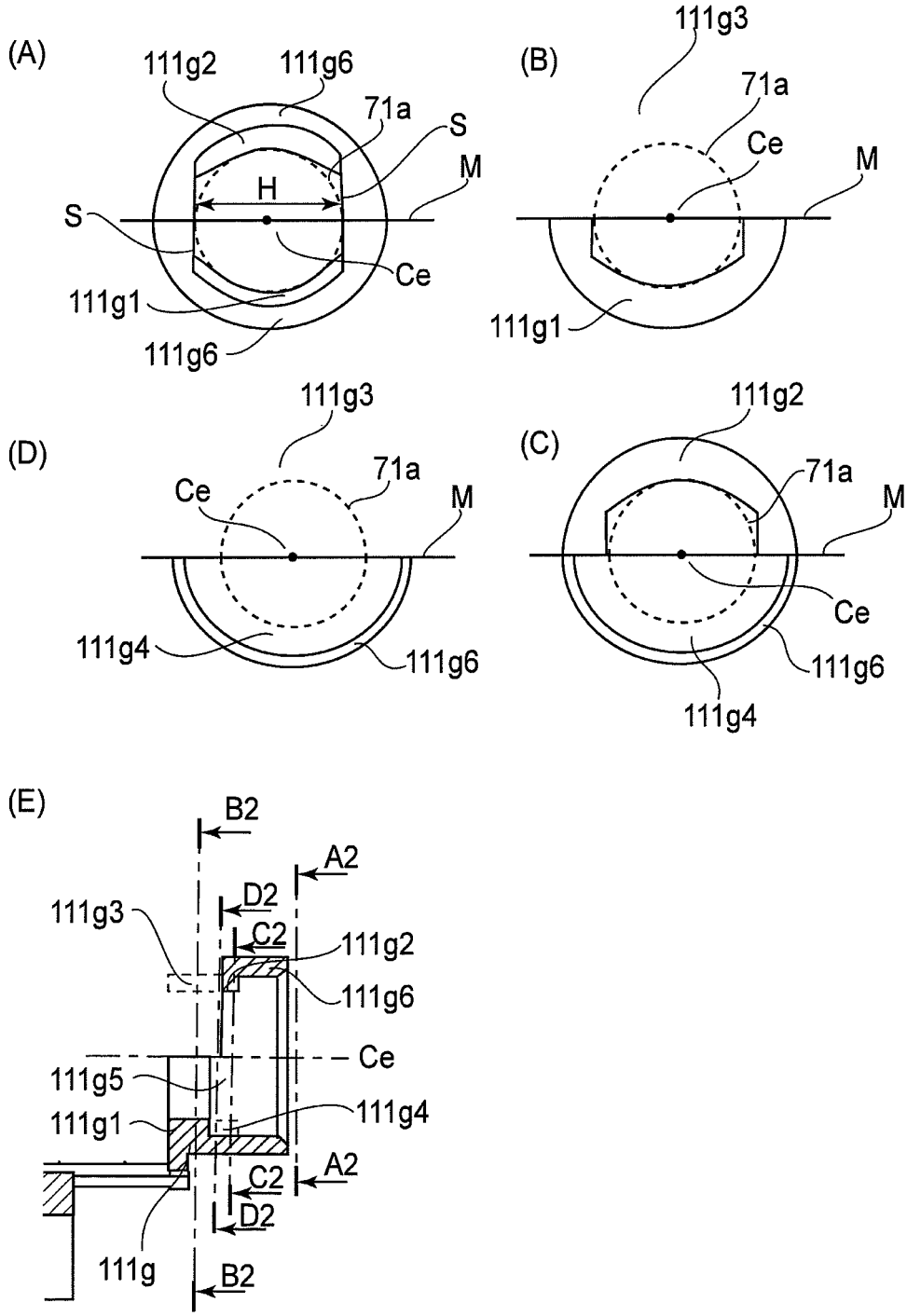
FIG. 9 relates to the photosensitive drum bearing in the second preferred embodiment of the present invention.

FIG. 9 shows the bearing 111g in the second preferred embodiment of the present invention. The bearing 111g is different from the bearing 11g (FIG. 8) in the first preferred embodiment of the present invention only in that in terms of cross section, its internal surface is not entirely circular. That is, the opposing two portions of the internal surface of the bearing 111g are flat. FIGS. 9(A)-9(D) are sectional views of the bearings 111g at planes A2-A2, B2-B2, C2-C2, and D2-D2 in FIG. 9(E), which are perpendicular to the axial line of the bearing 111g. The pair of flat portions S are parallel to each other, and are perpendicular to the aforementioned flat plane M. The distance between the two flat portions S is equal to the external diameter of the supporting shaft 71a so that the shaft 71a perfectly fits between the two flat portions S. The two flat portions S regulate the supporting shaft 71a in the movement perpendicular to the flat portions S, making it thereby easier to insert the supporting shaft 71a into the bearing 111g at an angle relative to the axial line of the bearing 111g.

Next, referring to FIG. 9(B), in this embodiment, the drum supporting shaft 71a is borne by a part of the semi-cylindrical inward surface of the bottom portion of the first portion 111g1 of the bearing 111g, and the two portions of the inward surface of the bearing 111g, which correspond in position to the intersection of the flat plane M, and the two flat portions S of the bearings 111g. Next, referring to FIG. 9(C), the drum supporting shaft 71a is also borne by a part of the semi-cylindrical inward surface of the top portion of the second portion 111g2 of the bearing 111g, and the two portions of the inward surface of the bearing 111g, which correspond in position to the intersection of the flat plane M, and the two flat portions S of the bearing 111g.

Embodiment 3

Figure 10:
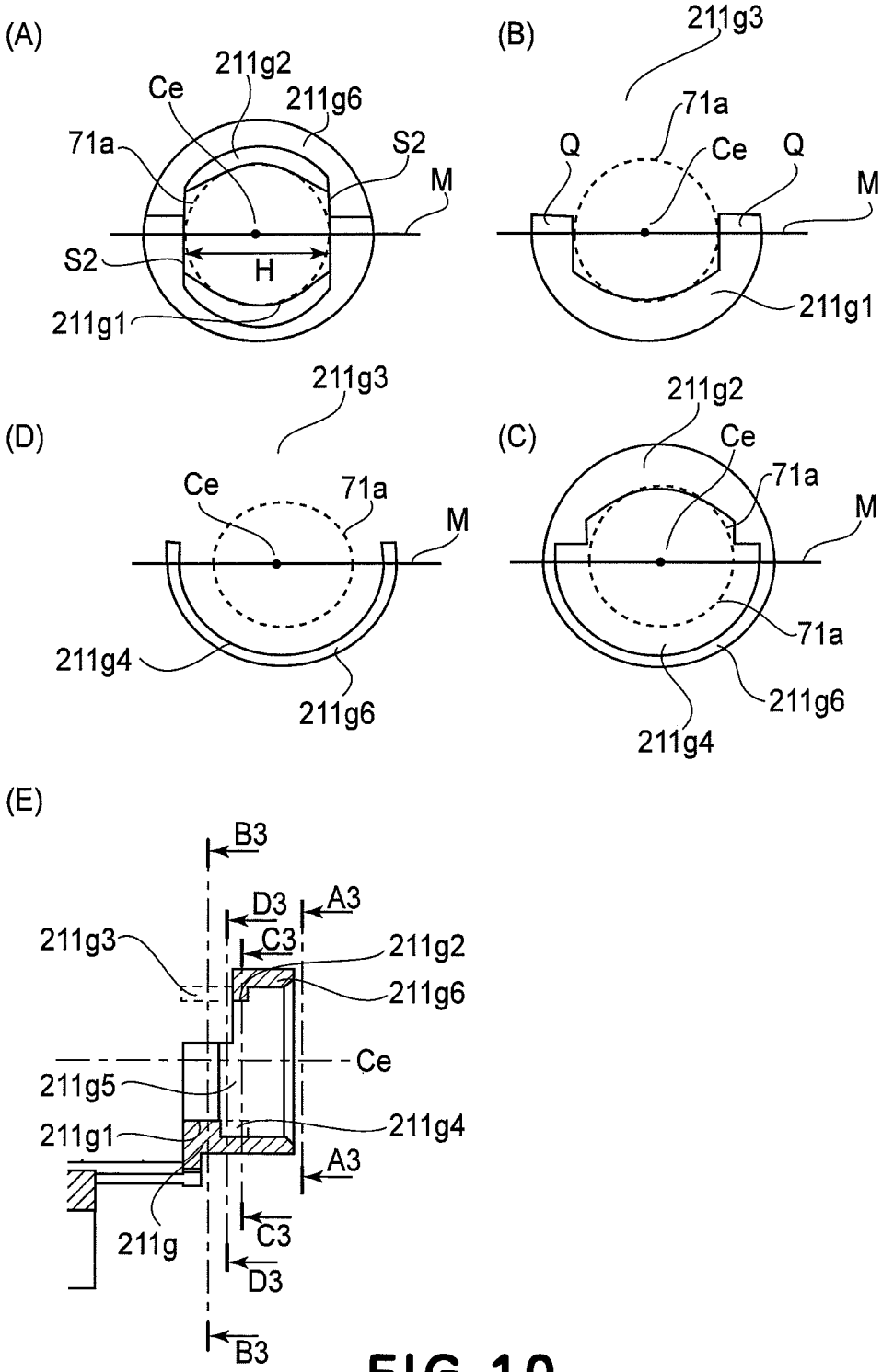
FIG. 10 relates to the photosensitive drum bearing in the third preferred embodiment of the present invention.

FIG. 10 shows the bearing 211g in the third preferred embodiment of the present invention. The bearing 211g is different from the bearing 111g (FIG. 9) in the second embodiment only in that the portions Q (10(B)) of the first portion 211g1 of the bearing 211g, which has the two flat portions S2 of the shaft bearing surface of the bearing 211g, is in the space in which the recess 211g3 is present. Also in this embodiment, however, the first recess 211g3 (which is on the top side of flat plane M) is on the opposite side of the flat plane M from the first portion 211g1 of the bearing 211g, because the portion of the first portion 211g1 of the bearing 211g, which actually bears the supporting shaft 71a, is on the bottom side of the flat plane M. That is, referring to FIG. 10(B), the drum supporting shaft 71a is borne by a part of the semi-cylindrical portion of the inward surface of the first portion 211g1 of the bearing 211g, and the portions of the inward surface of the first portion 211g1 of the bearing 211g, which correspond in position to the intersection of the flat plane M and the flat portions S2 of the bearings 211g. Also in this embodiment, the second recess 211g4 (which is below the flat plane M) is on the opposite side of the flat plane M from the second portion 211g2 of the bearing 211g.

FIGS. 10(A)-10(D) are sectional views of the bearings 211g at planes A3-A3, B3-B3, C3-C3, and D3-D3 in FIG. 10(E), which are perpendicular to the axial line of the bearing 211g. Referring to FIG. 10(B), not only are the portions of the first portion 211g1 of the bearing 211g, which have the flat portions S2, in the space below the flat plane M, but also, in the space above the flat plane M, that is, the space in which the recess 211g3 is present. However, this setup does not interfere with the insertion of the drum supporting shaft 71a into the bearing 211g at an angle relative to the axial line of the bearing 211g, because the portions of the supporting shaft supporting surface of the bearing 211g, which are on the top side of the flat plane M, are not semi-cylindrical, and flat. In this embodiment, the positional relationship between the first and second portions 211g1 and 211g2 of the bearing 211g relative to the flat plane M is not such that the entirety of the first portion 211g is on one side of the flat plane M, and the entirety of the second portion 211g2 is on the other side of the flat plane M. However, the positional relationship between the first and second recess 211g3 and 211g4 is such that the first recess 211g3 is on the opposite side of the flat plane M from the second recess 211g4. That is, the first recess 211g3 is on one side of the flat plane M, and the second recess 211g4 is on the other side.

Embodiment 4

Figure 11:
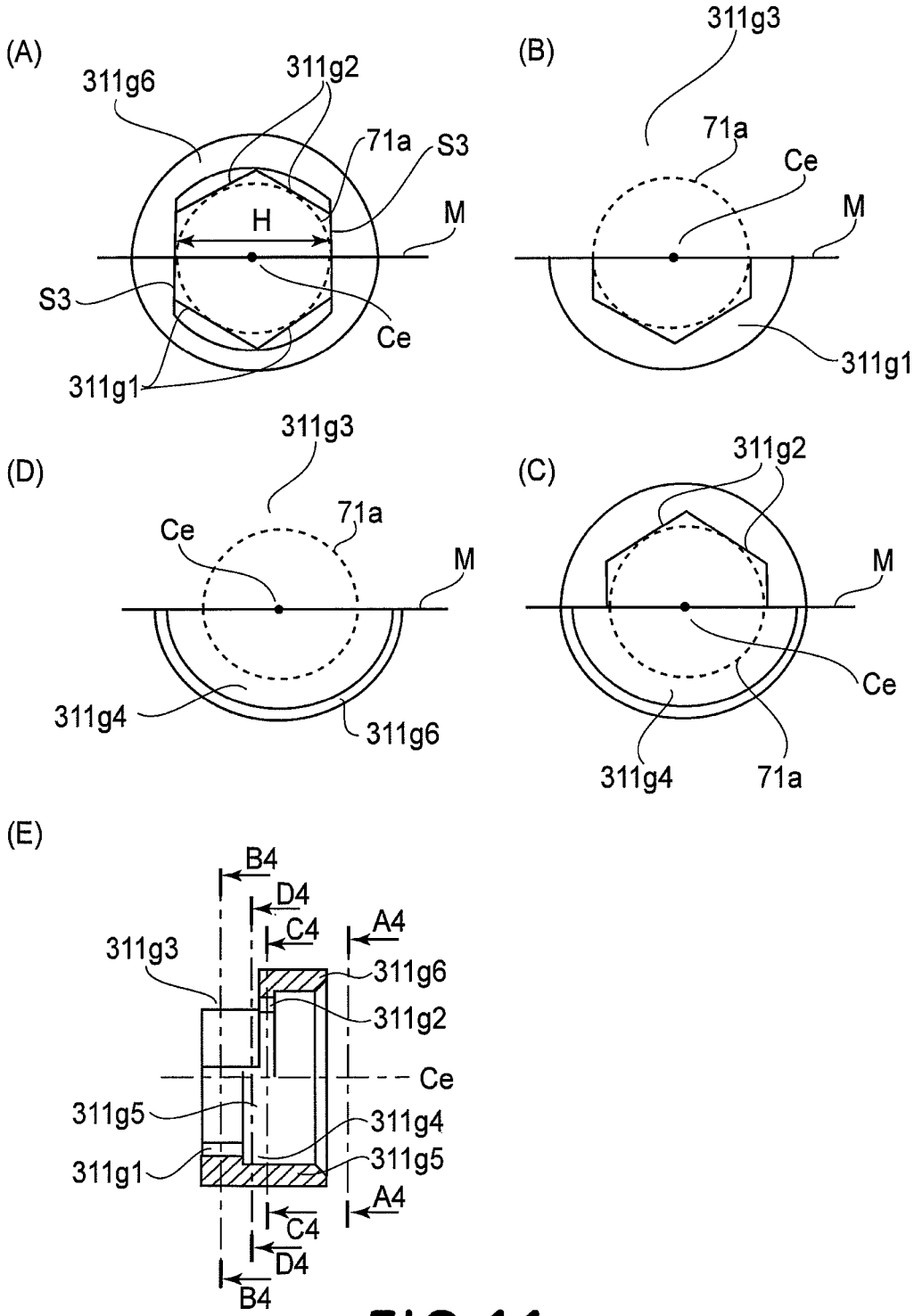
FIG. 11 relates to the photosensitive drum bearing in the fourth preferred embodiment of the present invention.

FIG. 11 shows the bearings 311g of the fourth preferred embodiment of the present invention. The fourth embodiment is different from the first to third embodiments only in that in the four embodiments, the drum supporting shaft bearing surface of the bearing 311g does not have any semi-cylindrical portion. More concretely, in this embodiment, the shaft bearing surface of the bearing 311g is hexagonal in cross section. That is, unlike in the second and third embodiments in which the bearing has a pair of flat portions, the bearing 311g in this embodiment has three pairs of flat portions. FIGS. 11(A)-11(D) are sectional views of the bearings 311g at planes A4-A4, B4-B4, C4-C4, and D4-D4 in FIG. 11(E), which are perpendicular to the axial line of the bearing 311g.

Embodiment 5

Figure 12:
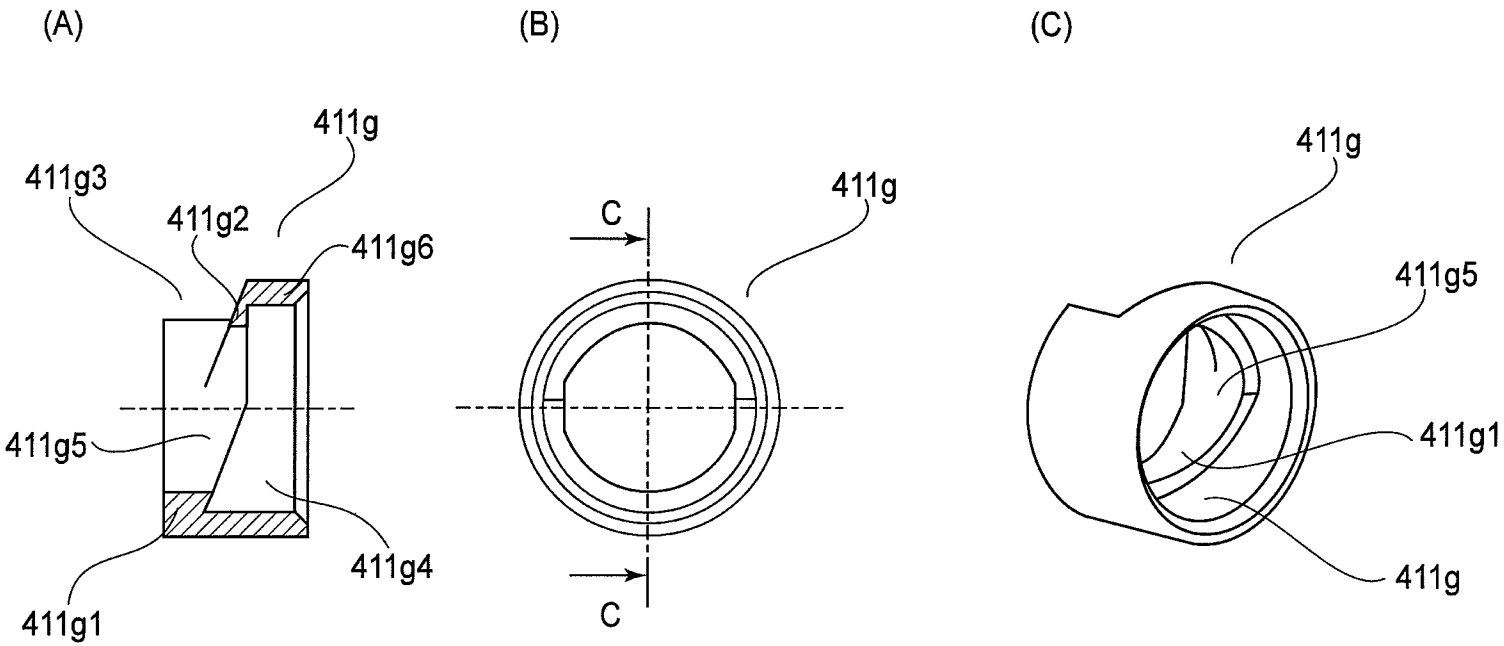
FIG. 12 relates to the bearing in the fifth preferred embodiment of the present invention.

This preferred embodiment is different in the joint of the bearing from the preceding ones. In the case of the bearing 411g shown in FIG. 12, the joint 411g5 is not perpendicular to the axial line of the first and second portions 411g1 and 411g2 of the bearing 411g. That is, parts of the joint 411g5 are angled relative to the axial line of the first and second portions 411g1 and 411g2 of the bearing 411g. In the cases of the first to fourth embodiments, when the supporting shaft 71a is inserted into the bearing, the joint was angled relative to the supporting shaft 71a. In comparison, in this embodiment, when the supporting shaft 71a is inserted into the bearing 411g, the supporting shaft 71a is perpendicular to parts of the joint 411g5.

Figure 13:
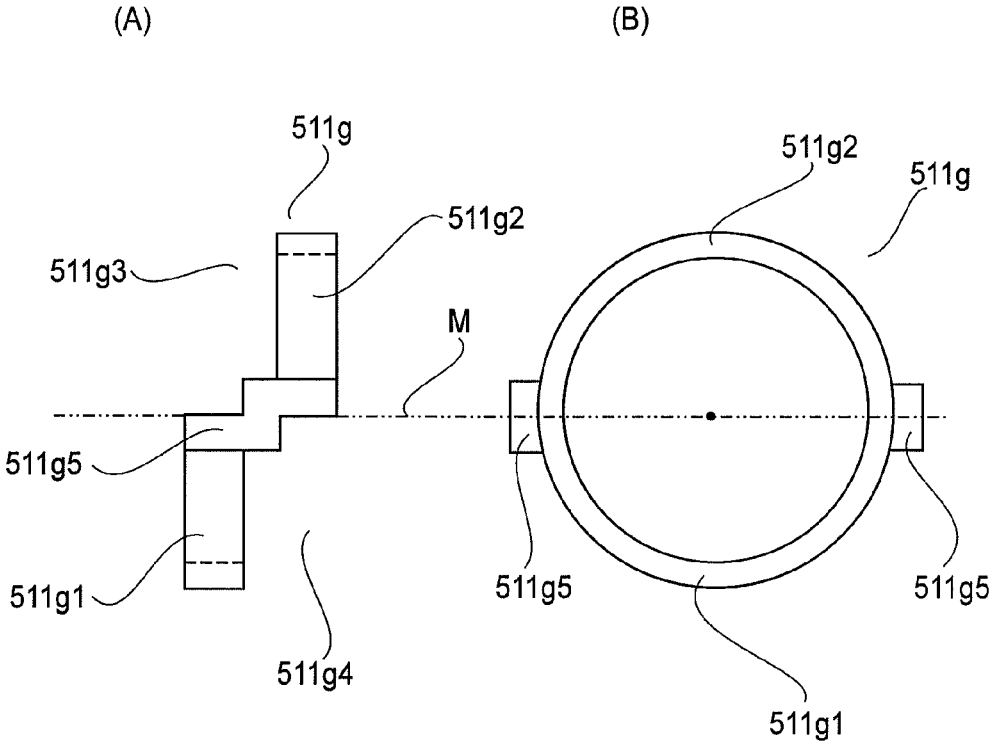
FIG. 13 relates to one of the modifications of the bearing in the fifth preferred embodiment of the present invention.
Figure 14:
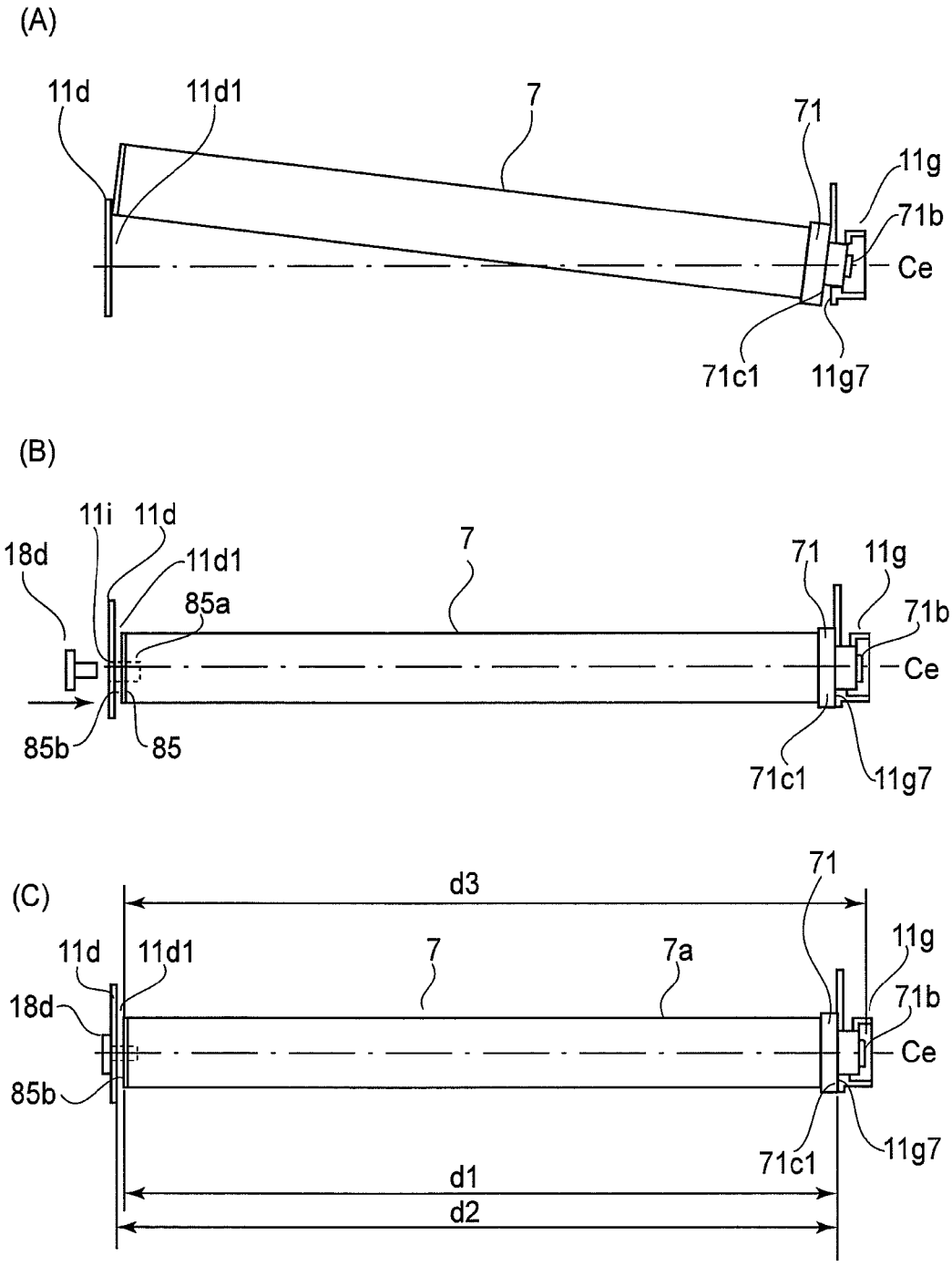
FIG. 14 relates to the procedure for mounting the photosensitive drum into the cartridge frame.

In the case of the bearing 511g shown in FIG. 13, the first and second portions 511g1 and 511g2 are in connection to each other only across the joint 511g5 of the bearing 511g, which is in the adjacencies of the flat plane M. Further, the bearing 511g does not have such a portion that is equivalent to the extension 11g6 of the bearing 11g in the first embodiment, which is on the opposite side of the plane M from the first portion 11g1 of the bearing 11g. Therefore, the bearings 511g is significantly smaller in size than those in the preceding embodiments.

In the preceding preferred embodiments of the present invention, the process cartridges were structured so that the drum supporting shaft was attached to the drum, and the bearing was attached to the frame of the cartridge. However, a process cartridge may be reversed in where the drum supporting shaft and bearing are attached. In other words, a process cartridge may be structured so that the drum supporting shaft is attached to the process cartridge frame, and the bearing is attached to the drum. In such a case, the drum is mounted into the cartridge frame at an angle relative to the axial line of the drum supporting shaft on the cartridge frame, in such a manner that the bearing on the drum is fitted around the drum supporting shaft on the cartridge frame. Further, the first and second portions of the bearing on the drum are placed opposite in position from those in the preceding embodiments. That is, the portion of the bearing, which first comes into contact with the tip of the drum supporting shaft on the cartridge frame, is the first portion of the bearing, and the portion of the bearing which next comes into contact with the drum supporting shaft is the second portion of the bearing. It is true also in this case that from the standpoint of strength, it is desired that the portion of the bearing, which first comes into contact with the tip of the drum supporting shaft, is made greater in dimension in terms of the axial line of the bearing than the portion of the bearing, which next comes into contact with the drum supporting shaft, as in the preceding embodiments.

Further, the process cartridges in the preceding embodiments described above were for an image forming apparatus for forming monochromatic images. However, the present invention is also compatible with process cartridges for a full-color image forming apparatus which has multiple developing means and is capable of forming multicolor images (two color images, three color images, or full-color images, for example).

In the cases of process cartridges in accordance with the prior art, the drum bearing or drum supporting shaft has to be attached to both lengthwise ends of a photosensitive drum, being therefore greater in the component count and assembly step count than process cartridge in accordance with the present invention. That is, in the cases of the preceding embodiments of the present invention, it is only to one of the lengthwise ends of the photosensitive drums that the bearing has to be attached. Further, in comparison to a process cartridge structured so that the drum supporting shaft can be inserted into the bearing at an angle relative to the axial line of the bearing, based on the clearance between the peripheral surface of the drum supporting shaft and the shaft supporting surface of the bearing, the process cartridges in the preceding embodiments of the present invention are smaller in the clearance between the drum supporting shaft and bearing, being therefore higher in the level of precision with which the drum is positioned relative to the cartridge frame, and also, are smaller in the size of the cartridge frame in terms of the direction parallel to the axial line of the drum. In other words, the present invention is suitable for reducing a process cartridge in size.

In the above, the present invention was described with reference to an electrophotographic image forming apparatus. However, the preceding preferred embodiments of the present invention are not intended to limit the present invention in scope. That is, the present invention is also applicable to image forming apparatuses which form latent images with the use of magnetism or electricity, instead of light.

The present invention makes it possible to provide a process cartridge which is significantly simpler in structure and is more precise in terms of how a photosensitive drum is supported by the cartridge frame than any of process cartridges in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 105348/2010 and 090966/2011 filed Apr. 30, 2010 and Apr. 15, 2011, respectively, which are hereby incorporated by reference.

What is claimed is:

1. A cartridge detachably mountable to an image forming apparatus, said cartridge comprising:

a photosensitive drum having a shaft provided adjacent to one axial end;

a frame that is provided with:

(i) a first bearing portion supporting a circumference of said shaft, and (ii) a second bearing portion supporting a circumference of said shaft, said second bearing portion being spaced from said first bearing portion with respect to the axial direction and being disposed at a side opposite from said first bearing portion with respect to a plane including an axis of said shaft at the time when said shaft is supported by said first bearing portion, and said second bearing portion being disposed outside of said first bearing portion with respect to the axial direction;

a first clearance space provided at a position opposite to said first bearing portion with respect to the plane, said first clearance space being disposed outside of a contact portion of said second bearing portion relative to said shaft with respect to a radial direction of said photosensitive drum and inside of said second bearing portion with respect to the axial direction; and a second clearance space provided at a position opposite to said second bearing portion with respect to the plane, said second clearance space being disposed outside of a contact portion of said first bearing portion relative to said shaft with respect to the radial direction and outside said first bearing portion with respect to the axial direction, wherein, in a process of causing said shaft to be supported by said first bearing portion, said shaft is capable of entering said first clearance space, and wherein in a process of causing said shaft to be supported by said second bearing portion, said shaft is capable of entering said second clearance space.

2. A cartridge according to claim 1, wherein said first bearing portion is closer to a peripheral surface of said photosensitive drum than said second bearing portion in the axial direction.

3. A cartridge according to claim 2, wherein said photosensitive drum is provided with a first portion-to-be-regulated adjacent to a second axial end that is opposite to said one axial end, and said frame is provided with a first regulating portion contactable to said first portion-to-be-regulated to limit movement of said photosensitive drum in the axial direction, and wherein a distance between said first portion-to-be-regulated and said one axial end of said shaft measured in the axial direction is longer than a distance between said first regulating portion and an end of said first bearing portion that is closest to said photosensitive drum.

4. A cartridge according to claim 3, wherein said photosensitive drum is provided with a second portion-to-be-regulated adjacent to said one axial end, and said frame is provided with a second regulating portion contactable to said second portion-to-be-regulated to limit movement of said photosensitive drum in the axial direction, and wherein said second regulating portion is disposed at an end of said first bearing portion that is closest to said photosensitive drum.

5. A cartridge according to claim 1, wherein said photosensitive drum is provided with a supporting hole adjacent to a second axial end of said shaft, said supporting hole being effective to position said photosensitive drum with respect to a direction perpendicular to the axial direction.

6. A cartridge according to claim 2, wherein a length of said first bearing portion measured in the axial direction is longer than that of said second bearing portion.

7. A cartridge according to claim 1, wherein said cartridge is a process cartridge including process means actable on said photosensitive drum.

8. An image forming apparatus for forming an image on a recording material, said image forming apparatus comprising:

a photosensitive drum having a shaft provided adjacent to one axial end;

a frame that is provided with:

(i) a first bearing portion supporting a circumference of said shaft, and (ii) a second bearing portion supporting a circumference of said shaft, said second bearing portion being spaced from said first bearing portion with respect to the axial direction and being disposed at a side opposite from said first bearing portion with respect to a plane including an axis of said shaft at the time when said shaft is supported by said first bearing portion, and said second bearing portion being disposed outside of said first bearing portion with respect to the axial direction;

a first clearance space provided at a position opposite to said first bearing portion with respect to the plane, said first clearance space being disposed outside of a contact portion of said second bearing portion relative to said shaft with respect to a radial direction of said photosensitive drum and inside of said second bearing portion with respect to the axial direction; and a second clearance space provided at a position opposite to said second bearing portion with respect to the plane, said second clearance space being disposed outside of a contact portion of said first bearing portion relative to said shaft with respect to the radial direction and outside said first bearing portion with respect to the axial direction, wherein, in a process of causing said shaft to be supported by said first bearing portion, said shaft is capable of entering said first clearance space, and wherein in a process of causing said shaft to be supported by said second bearing portion, said shaft is capable of entering said second clearance space.

9. An apparatus according to claim 8, wherein said first bearing portion is closer to a peripheral surface of said photosensitive drum than said second bearing portion in the axial direction.

10. An apparatus according to claim 9, wherein said photosensitive drum is provided with a first portion-to-be-regulated adjacent to a second axial end that is opposite to said one axial end, and said frame is provided with a first regulating portion contactable to said first portion-to-be-regulated to limit movement of said photosensitive drum in the axial direction, and wherein a distance between said first portion-to-be-regulated and said one axial end of said shaft measured in the axial direction is longer than a distance between said first regulating portion and an end of said first bearing portion that is closest to said photosensitive drum.

11. An apparatus according to claim 10, wherein said photosensitive drum is provided with a second portion-to-be-regulated adjacent to said one axial end, and said frame is provided with a second regulating portion contactable to said second portion-to-be-regulated to limit movement of said photosensitive drum in the axial direction, and wherein said second regulating portion is disposed at an end of said first bearing portion that is closest to said photosensitive drum.

12. An apparatus according to claim 8, wherein said photosensitive drum is provided with a supporting hole adjacent to a second axial end of said shaft, said supporting hole being effective to position said photosensitive drum with respect to a direction perpendicular to the axial direction.

13. A mounting method for manufacturing a cartridge that is detachably mountable to an image forming apparatus, the cartridge including a photosensitive drum having a shaft provided adjacent to one axial end; a frame being provided with (i) a first bearing portion supporting a circumference of the shaft and (ii) a second bearing portion supporting a circumference of the shaft, with the second bearing portion being spaced from the first bearing portion with respect to the axial direction and being disposed at a side opposite from the first bearing portion with respect to a plane including an axis of the shaft at the time when the shaft is supported by the first bearing portion; the second bearing portion being disposed outside of the first bearing portion with respect to the axial direction; a first clearance space provided at a position opposite to the first bearing portion with respect to the plane, wherein in a process of causing the shaft to be supported by the first bearing portion, the shaft is capable of entering the first clearance space, the first clearance space being disposed outside of a contact portion of the second bearing portion relative to the shaft with respect to a radial direction of the photosensitive drum and inside of the second bearing portion with respect to the axial direction; and a second clearance space provided at a position opposite to the second bearing portion with respect to the plane, wherein in a process of causing the shaft to be supported by the second bearing portion, the shaft is capable of entering the second clearance space, the second clearance space being disposed outside of a contact portion of the first bearing portion relative to the shaft with respect to the radial direction and outside the first bearing portion with respect to the axial direction, the method comprising:

a first step of moving the photosensitive drum such that a part of the shaft enters the first clearance space in a state that the photosensitive drum extends in a direction crossing the axis;

a second step, after the first step, of moving the photosensitive drum such that a part of the shaft enters the second clearance space in a state that the photosensitive drum extends in a direction crossing the axis; and a third step of moving such that the shaft is brought into contact to the first bearing portion and the second bearing portion from a state that the photosensitive drum extends in a direction crossing the axis.

14. A method according to claim 13, further comprising a fourth step of positioning, relative to the frame, a supporting hole provided adjacent to a second axial end that is opposite to the one axial end of the photosensitive drum.

* * * * *